US011424587B2

(12) United States Patent
Glockseisen et al.

(10) Patent No.: US 11,424,587 B2
(45) Date of Patent: Aug. 23, 2022

(54) CRIMPING TOOL

(71) Applicant: WEZAG GmbH Werkzeugfabrik, Stadtallendorf (DE)

(72) Inventors: Thomas Glockseisen, Duesseldorf (DE); Roman Zinser, Neustadt (DE)

(73) Assignee: WEZAG GMBH & CO. KG, Stadtallendorf (DE)

( * ) Notice: Subject to any disclaimer, the term of this patent is extended or adjusted under 35 U.S.C. 154(b) by 807 days.

(21) Appl. No.: 16/377,521

(22) Filed: Apr. 8, 2019

(65) Prior Publication Data

US 2019/0319417 A1 Oct. 17, 2019

(30) Foreign Application Priority Data

Apr. 11, 2018 (EP) ..... 18166729

(51) Int. Cl.
*H01R 43/042* (2006.01)

(52) U.S. Cl.
CPC ..... *H01R 43/042* (2013.01); *Y10T 29/53226* (2015.01)

(58) Field of Classification Search
CPC ..... H01R 43/042; H01R 43/0421; Y10T 29/53226; Y10T 29/53257; B25B 7/00;
(Continued)

(56) References Cited

U.S. PATENT DOCUMENTS 4,048,877 A 9/1977 Undin
4,381,661 A * 5/1983 Wiener ..... B25B 7/12 81/418

(Continued)

FOREIGN PATENT DOCUMENTS

DE 197 09 639 A1 9/1998
DE 19 802 287 C1 12/1998

(Continued)

OTHER PUBLICATIONS

WEZAG GmbH Werkzeugfabrik, Die Bibliothek der Technik 342, Verlag Moderne Industrie, ISBN 978-3-68236-027-7: Crimptechnik, production of connections being reliable in the process of electric conductors and plugs (Oct. 12, 2011).

(Continued)

*Primary Examiner* — Peter Dungba Vo
*Assistant Examiner* — Joshua D Anderson
(74) *Attorney, Agent, or Firm* — Thomas | Horstemeyer, LLP

(57) ABSTRACT

The invention relates to pressing or crimping pliers (1). According to the invention a spring device (35) (which is e.g. embodied as U-shaped leaf spring (36)) is used in the crimping pliers. In an equilibrium position (48) the leaf spring (36) is trapped between stops (49, 50). If the pressing or crimping pliers (1) are moved from the equilibrium position (48) in closing direction the leaf spring (36) is biased by a follower (54) such that the leaf spring (36) generates an opening force. In reversed direction the opening movement of the pressing or crimping pliers (1) from the equilibrium position (48) leads to a bias of the leaf spring (36) by a follower (55) such that the leaf spring is able to generate a closing force. According to the invention it is possible to provide that the pressing or crimping pliers (1) automatically and elastically open when reaching the closed position. Furthermore, a workpiece inserted into the pressing or crimping pliers (1) is clamped by a closing force and secured in this way.

17 Claims, 14 Drawing Sheets

(58) Field of Classification Search
CPC .. B25B 7/12; B25B 7/123; B25B 7/14; B25B 7/16; B25B 27/14; B25B 27/146
See application file for complete search history.

(56) References Cited

U.S. PATENT DOCUMENTS

| | | | | |
|---|---|---|---|---|
| 5,280,716 | A | 1/1994 | Ryan et al. | |
| 5,509,291 | A | 4/1996 | Nilsson et al. | |
| 5,649,444 | A | 7/1997 | Nilsson et al. | |
| 6,053,025 | A | 4/2000 | Beetz et al. | |
| 6,286,358 | B1 | 9/2001 | Beetz et al. | |
| 6,289,712 | B1 | 9/2001 | Beetz et al. | |
| 6,474,130 | B2 | 11/2002 | Battenfeld | |
| 6,508,149 | B1 * | 1/2003 | Heggemann | B25B 27/146 81/320 |
| 6,612,206 | B1 * | 9/2003 | Heggemann | B25B 27/146 81/392 |
| 7,155,954 | B2 | 1/2007 | Battenfeld | |
| 7,444,907 | B2 * | 11/2008 | Seber | B25B 7/123 81/367 |
| 8,127,589 | B2 | 3/2012 | Battenfeld | |
| 8,245,560 | B2 | 8/2012 | Battenfeld et al. | |
| 9,864,948 | B2 | 1/2018 | Glockseisen | |
| 2007/0289353 | A1 | 12/2007 | Fiorisi | |
| 2017/0239788 | A1 | 8/2017 | Battenfeld | |

FOREIGN PATENT DOCUMENTS

| | | | |
|---|---|---|---|
| DE | 198 34 859 | C2 | 1/2001 |
| DE | 199 63 097 | C1 | 4/2001 |
| DE | 199 24 087 | C2 | 6/2002 |
| DE | 199 24 086 | C2 | 8/2002 |
| DE | 103 46 241 | B3 | 8/2004 |
| DE | 10 2008 005 472 | B3 | 2/2009 |
| DE | 10 2007 001 235 | B4 | 6/2010 |
| EP | 2 995 424 | A1 | 9/2014 |
| EP | 3 208 044 | A1 | 2/2016 |
| WO | 93/19897 | A1 | 10/1993 |

OTHER PUBLICATIONS

Product catalogue of the WEZAG GmbH Werkzeugfabrik, publication No. 10/11: "Tools for professional application", Nov. 1, 2011.

* cited by examiner

CRIMPING TOOL

CROSS REFERENCE TO RELATED APPLICATIONS

This application claims priority to co-pending European Patent Application No. EP 18 166 729.6-1201 filed Apr. 11, 2018.

FIELD OF THE INVENTION

The present invention relates to pressing or crimping pliers. By means of the pressing or crimping pliers a pressing or crimping of a workpiece can be conducted by a manual actuation of hand levers.

Here, crimping pliers in particular serve for producing a permanent mechanical connection and an electric contact. This is preferably provided by crimping a plug to a cable or to an electric conductor of any design. Dependent on the profile of the dies used it is possible to execute different crimping processes with the crimping pliers. It might e.g. be a closed crimp where the conductor is inserted into a closed crimping zone of a plug or into a closed sleeve and where the conductor is crimped under a plastic deformation of the crimping zone or sleeve. However, it is also possible that an open crimp is produced where the plug comprises an open crimping zone into which the conductor can be inserted from above. To mention only some examples which are not intended to limit the invention, by means of the present crimping tool it is possible to crimp

- cable shoes according to DIN 4623,
- aluminum connectors according to DIN 46329,
- aluminum pressed cable shoes according to DIN 48201,
- squeezed cable shoes according to DIN 46234,
- pin cable shoes according to DIN 46230 or
- connectors, plugs or cable shoes for establishing a connection with a cable or conductor as described in the product catalogue of the WEZAG GmbH Werkzeugfabrik "Tools for professional application" with the publication no. 10/11.

The produced crimp might e.g. be a closed crimp embodied as six-edges or hexagonal crimp, four-edges crimp, B-crimp, trapeze crimp, modified trapeze crimp, oval crimp, mandrel crimp or two-mandrel crimp. An open crimp might e.g. be embodied as V-crimp or B-crimp, rolled crimp or double-rolled crimp.

Additional to the production of an electric connection between a cable or conductor and a plug it is possible that a mechanical connection is produced by means of a so-called insulation crimp. Here, a closed insulation crimp or open insulation crimp (in particular V-crimp, B-crimp, O-crimp or OV-crimp) can be used. For further information

- concerning the design of generic crimping pliers,
- concerning possible fields of uses of the generic crimping pliers and/or
- concerning different possible types of crimping connections which can be produced by means of the generic crimping pliers reference is made to the publication
- "Crimptechnik, production of connections being reliable in the process of electric conductors and plugs" of the WEZAG GmbH Werkzeugfabrik, Die Bibliothek der Technik 342, Verlag Moderne Industrie, ISBN 978-3-68236-027-7.

Instead, generic pressing pliers are preferably used for providing a mechanical fluid-sealed connection in the technical field of fluids, e.g. for connecting tubes to each other or to a fluidic connector plug. Here, by means of the pressing pliers it is possible to induce a plastic deformation of the tubes which have to be connected to each other or of a so-called fitting which provides the mechanical connection and the fluidic sealing effect. Exemplary embodiments of generic pressing pliers can be taken from the publications DE 197 09 639 A1, DE 198 34 859 C2, DE 199 24 086 C2 corresponding to U.S. Pat. No. 6,286,358 B1, DE 199 24 087 C2 corresponding to U.S. Pat. No. 6,289,712 B1, DE 199 63 097 C1 corresponding to U.S. Pat. No. 6,474,130 B2, DE 103 46 241 B3 corresponding to U.S. Pat. No. 7,155,954 B2, DE 10 2007 001 235 B4 corresponding to U.S. Pat. No. 8,127,589 B2, DE 10 2008 005 472 B3 corresponding to U.S. Pat. No. 8,245,560 B2, EP 3 208 044 A1 corresponding to US 2017/0239788 A1, EP 2 995 424 A1 corresponding to U.S. Pat. No. 9,864,948 B2.

U.S. Pat. No. 5,280,716 A discloses crimping pliers wherein a fixed pliers part forms a fixed hand lever and a fixed pliers jaw. In the region of the pliers head a movable pliers jaw is linked to the fixed pliers part by a pivot joint. At a position remote from the pivot joint a movable hand lever is linked to the movable pliers jaw. Additionally, the movable hand lever is supported by a pressure lever at the fixed hand lever. A spring base of a first spring is linked to the movable hand lever at a position located between the pivot joint and the linkage of the pressure lever whereas the other spring base is linked to the fixed hand lever. The first spring biases the movable hand lever in opening direction. A second spring (which is here embodied as torsional leg spring) biases the pressure lever in opening direction. Due to the effect of the two springs without any bias of the hand levers by the hand of the user the crimping pliers take an open position whereas an at least partial closure of the hand levers requires the application of closing forces by the user upon the hand lever. The bolt by which the pressure lever is linked to the movable hand lever is guided in an elongated hole in a way such that the bolt is able to take a first position and a second position. In the region between an open position and a partially closed position the bolt takes a first position wherein a driving connection formed by a toggle lever drive comprises a comparatively large transmission ratio. Accordingly, small forces are generated in the region of the pliers jaws but it is possible to achieve large closing angles of the pliers jaws. When reaching the partially closed position for which the dies held at the pliers jaws start to contact the outer circumference of the workpiece, due to the orientation of the elongated hole the bolt is automatically transferred into the second position such that the driving connection is switched to a smaller transmission ratio. By the smaller transmission ratio it is possible to achieve higher forces at the pliers jaws. Intermediate closing positions can be secured by a forced locking unit.

For crimping pliers according to U.S. Pat. No. 4,048,877 A (which with respect to other aspects generally have a corresponding design) the movable hand lever is not supported by a pressure lever at the fixed hand lever. Instead, the movable hand lever carries a roller which over the crimping stroke rolls along a cam profile of the fixed hand lever. Dependent on the contour of the cam profile the rolling movement leads to a change of the transmission ratio of the driving mechanism. For these crimping pliers a first spring being effective directly between the hand levers guarantees that the roller always contacts the cam profile. A second spring biases the two pliers jaws in opening direction. If the cam profile comprises at least one valley with the entry of the roller supported by the movable hand lever into the valley a stable intermediate position can be provided wherein the crimping pliers are not further opened by the second spring. This is due to the fact that for the further opening of the crimping pliers the roller would have to pass over a rising region limiting the valley against the effect of the first spring. Also these crimping pliers comprise a forced locking unit.

Further crimping pliers are known from WO 93/19897 A1 corresponding to U.S. Pat. Nos. 5,509,291 A and 5,649,444 A.

SUMMARY OF THE INVENTION

The present invention proposes manually actuated pressing pliers or crimping pliers which are improved with respect to the force conditions, the operational comfort and the operational safety.

The invention bases on the finding that when designing pressing pliers or crimping pliers a conflict of objectives might occur:

a) On the one hand it might be desirable that in the pressing pliers or crimping pliers a spring is effective between the pliers jaws. The spring biases the pliers jaws in closing direction. In this case the bit of tongs formed by the dies of the pressing pliers or crimping pliers is opened by an opening of the pliers jaws induced by the drivingly connected hand levers against the bias of the spring. If then a workpiece is introduced into the bit of tongs, the spring biases the pliers jaws towards each other when releasing the hand levers. Accordingly, also without manual application of a force upon the hand levers due to the spring the workpiece is clamped between the dies. In this way, it is possible that the workpiece is secured in position in the bit of tongs and secured against an undesired falling out.

b) On the other hand, it has shown that it might be advantageous if the pressing pliers or crimping pliers on its own open when the working stroke has been passed. Accordingly, in known pressing pliers or crimping pliers also a spring can be used which biases the pliers jaws in opening direction.

For pressing or crimping pliers known from the prior art the conflict of objectives has not been resolved. Accordingly, (dependent on the evaluation of the importance of the aforementioned, opposing objectives) the manufacturer of the pressing pliers or crimping pliers had to decide for a spring being effective in opening direction or a spring being effective in closing direction.

According to the invention crimping pliers or pressing pliers are proposed which comprise two pliers jaws (which support or form dies). The pliers jaws can be drivingly connected by a suitable drive connection to two hand levers. Here, by a relative movement of the hand levers over a working stroke it is possible to transfer the pliers jaws from an open position of the pliers jaws into a closed position of the pliers jaws. Here, the working stroke might comprise an "empty stroke" wherein the dies are initially brought into contact with the workpiece as well as a pressing or crimping stroke wherein the workpiece is pressed or crimped between the dies. In the inventive pressing or crimping pliers at least one spring device is used.

Within the frame of the invention the at least one spring device has a particular design and is integrated into the force flow in a particular way: To start with, the at least one spring device comprises an equilibrium position. In the equilibrium position the spring device does not apply a force upon the pliers jaws. Accordingly, when using one single spring device the spring device is not tensioned in the equilibrium position (or only tensioned to an extent being sufficiently small such that friction or another resistance being present in the pressing pliers or crimping pliers cannot be overcome). In the case of the use of a plurality of spring devices these can all not be tensioned or the effect of the tensioned spring devices cancel each other out. Here, the mentioned equilibrium position of the pliers jaws is positioned between the open position and the closed position of the pliers jaws (e.g. positioned at a location between 20% to 80% or between 30% to 60% of the working stroke).

The equilibrium position divides the working stroke into a first working stroke part which is positioned between the open position and the equilibrium position of the pliers jaws and a second working stroke part which is positioned between the equilibrium position and the closed position. In the first working stroke part at least one spring device applies a closing force upon the pliers jaws. Instead, in the second working stroke part the spring device applies an opening force upon the pliers jaws.

The inventive design in particular allows the following advantageous operations of the pressing or crimping pliers:

- At the beginning of a pressing process or crimping process the pressing pliers or crimping pliers are in the equilibrium position. The equilibrium position is stable which is due to the fact that the spring device for small deflections in opening direction produces a closing force and for small deflections in closing direction produces an opening force. In this way it is possible to automatically achieve a return into the equilibrium position.
- If a workpiece is to be inserted into the bit of tongs (formed by the dies of the crimping pliers or pressing pliers), the user is able to induce an opening of the pliers jaws towards the open position by application of an opening force upon the hand lever.
- If the workpiece has been inserted into the bit of tongs and if the dimensions of the workpiece compared to the size of the bit of tongs are such that without a pressing or crimping of the workpiece a closing of the pliers jaws with the dies back into the equilibrium position is not possible, the pliers jaws with the dies are pressed by the spring device with the closing force against the workpiece. In this way a securing of the position and/or orientation of the workpiece in the bit of tongs (and also a securing of the workpiece against falling out of the bit of tongs) can be provided also when the user does not apply a closing force upon the hand levers.
- If then the pressing or crimping stroke is executed by an inducement of the closed position of the pliers jaws by the user by means of an application of a closing force upon the hand levers, after the end of the pressing or crimping stroke the spring device is able to apply an opening force upon the pliers jaws in the second working stroke part. Hereby, after the removal of the closing forces applied by the user upon the hand levers the bit of tongs automatically "snaps" in opening direction.

Preferably, the spring device generates a non-linear characteristic of the spring force. The non-linear characteristic of the spring force in particular comprises a kink and/or a jump at the equilibrium position or between the two working stroke parts.

The spring device might comprise one or a plurality of spring(s). Here, the at least one spring might be made of any material (e.g. metal, plastic, an elastomeric material) or also from a composite material. The spring might be a compression spring, an extension spring, a tilting angle spring, a torsional spring or a spring of any other construction. In the case of the use of a plurality of springs the springs can be arranged in mechanical series arrangement or parallel arrangement and/or can be integrated at different positions in the force flow. It is also possible that one spring is effective in opening direction and another spring is effective in closing direction. Preferably, the spring device produces a non-linear characteristic which comprises a kink and/or a jump at the equilibrium position or between the two working stroke parts.

For one embodiment the spring device comprises a closing spring and an opening spring. In this case in the first working stroke part the closing spring generates the closing force whereas in the second working stroke part the opening spring generates the opening force. Here, it is possible that in the first working stroke part the opening spring is decoupled from the driving connection whereas in the second working stroke part the closing spring is decoupled from the driving connection.

For another variant the spring device comprises (preferably only) one spring. This spring is then used in a multifunctional way which is due to the fact that the spring both generates the closing force in the first working stroke part as well as the opening force in the second working stroke part.

Within the frame of the invention it is generally possible that a spring of the spring device is coupled over the whole working stroke to the movement of the pliers jaws. In this case, also the bias of the spring changes over the whole working stroke. For one particular embodiment of the invention the pressing pliers or crimping pliers comprise at least one stop. The stop defines an external displacement of a spring base of the spring device which is preferably a minimum of the displacement. Furthermore, for this design the pressing pliers or crimping pliers comprise a follower. In one working stroke part the follower takes the spring base of the spring device along and moves the spring base of the spring device away from the stop which then leads to a change of the bias of the spring. Preferably, in the other working stroke part the spring base of the spring device remains at the stop. Accordingly, in the other working stroke part the bias of the spring does not change.

In the case that the spring is a compression spring, the stop defines a minimum of the compressional bias of the compression spring. In the working stroke part wherein the follower takes the spring base of the compression spring along and moves the spring base of the compression spring away from the stop, the compression force in the compression spring increases. The increasing compression force of the compression spring might then be used for generating the closing force or the opening force. The corresponding applies when using an extension spring—here, the stop defines a minimum of the pulling force of the extension spring whereas with the further bias of the extensional spring by the follower the extension and the pulling force increase.

For a particular proposal of the invention two stops and associated followers are provided. In the equilibrium position one single spring can be trapped between the two stops. In this case, during the first working stroke part by one follower a spring base of the spring is taken along. In the other working stroke part the other spring base is taken along by the other follower. If instead two springs are used, in the equilibrium position each spring might be supported at an associated stop. Whereas in this case in one working stroke part one follower moves the spring base of a spring away from the associated stop, the other spring base still remains at the associated stop. In the other working stroke part then the other follower moves the spring base of the other spring away from the associated stop whereas in this case the spring base of the first mentioned spring still remains supported at the stop.

The at least one stop and the at least one follower might be arranged on any constructional element of the pressing pliers or crimping pliers as long as during the working stroke there is a relative movement of the constructional elements on which the stop and the follower are arranged. It is e.g. possible that the follower is supported at a hand lever whereas the associated stop is fixed at or mounted to a (preferably moved) pliers jaw. However, for one embodiment of the pressing pliers or crimping pliers the stop is fixed at or mounted to the pliers head or supported by the same whereas the follower is mounted to or fixed at a pliers jaw moved relative to the pliers head over the working stroke or supported by the same. In the case that two stops and followers are provided, this might apply for both stops and followers.

Generally, the at least one spring of the spring device might have any design. For a particular embodiment of the spring device one single spring is used which is embodied as U-shaped bending spring or leaf spring. A bending spring or leaf spring of this type is a spring having a simple construction and a long lifetime. For a spring of this type it is possible to define by constructive measures the stiffness and any non-linearity of the stiffness conditions by the choice of the cross sections of the bending spring or leaf spring and if applicable, the change of the cross section, by the curvature of the longitudinal axis of the bending spring or leaf spring, by the used material and by the effective length of the bending spring or leaf spring. By giving the bending spring or leaf spring an U-shaped design it is possible to use differing spring arms of the U for the provision of the stiffness.

A particularly good integration of the U-shaped bending spring or leaf spring into the pressing pliers or crimping pliers might for one embodiment of the invention result if the spring arms of the U-shaped bending spring or leaf spring extend in the direction of a longitudinal axis of the pliers head or in the direction of the closed hand levers. For another proposal the pressing pliers or crimping pliers comprise a forced locking unit. A forced locking unit of this type secures a partially closed position of the pliers jaws once reached against an opening. In this way also when temporarily removing the hand forces applied upon the hand levers a reached partially closed position will be maintained. A forced locking unit of this type allows an opening of the pliers jaws only when the working stroke has completely been run through. With these measures it is possible to increase the safety of the process. Due to the inventive design after the complete passing of the working stroke (so for the unlatching of the forced locking unit) the spring device automatically returns the pliers jaws into the equilibrium position. Preferably, within the frame of the invention the forced locking unit has a design such that the forced locking unit is only effective in the second working stroke part (or also only in an end-sided sub-portion of the same) so that in the first working stroke part the forced locking unit does not interfere with the effect of the spring device strived for.

Within the frame of the invention it is generally possible that due to the effect of the spring device the open position (wherein it is possible to insert the workpiece into the bit of tongs) is only maintained if the user applies opening forces upon the hand levers or upon the pliers jaws which oppose the bias of the pliers jaws by the spring device. For another proposal of the invention the need that the crimping pliers or pressing pliers are held manually in the open position can be removed: for this proposal a latching device or locking device is provided. The latching device or locking device secures the open position so that (despite of the closing force of the spring device being effective in the open position) it is possible to automatically maintain the open position.

Here, a latching device is in particular understood to be a device which effects a latching which produces a latching force being higher than the closing force generated by the spring device. By an application of manual closing forces (e.g. via the hand levers or by closing forces directly applied upon the pliers jaws) it is possible to over-press the latching so that the open position will be left. If the latching is over-pressed in this way, the latching force is at least partially removed. Due to this removal the closing force generated by the spring device becomes dominant. Accordingly, a return into the equilibrium position (or an establishment of a contact of the dies with the workpiece due to the spring device) is possible.

Instead, a locking device is in particular understood to be a device by which an open position is locked in a way such that the open position cannot be left simply by the application of closing forces (e.g. by closing forces applied via the hand levers or directly applied upon the pliers jaws). Instead, a manual actuation of a locking element is required which then releases the locking so that then the spring device is able to return the pliers jaw into the equilibrium position or to induce an establishment of a contact of the die with the workpiece.

It is generally possible that in the latching device or locking device a separate latching or locking spring is used. For one embodiment of the pressing pliers or crimping pliers the or a spring of the spring device is multifunctional due to the fact that this spring both generates the opening force and/or closing force. Furthermore, this spring also generates a latching force of the latching device or a locking force of the locking device.

For the constructive design of a spring being multifunctional in this way there are a lot of options. For one proposal the spring arm of the U-shaped bending spring or leaf spring forms or carries a latching spring arm of the latching device. The latching spring arm in this case elastically forms the latching element or elastically supports the latching element. The latching element interacts in a latching way with a counter latching element. Here, over the working stroke and in particular in the neighborhood of the open position there is a relative movement of the counter latching element relative to the latching element.

Another embodiment of the pressing pliers or crimping pliers is directed to a particular constructive design of the pressing pliers or crimping pliers and a particular driving kinetic: for this embodiment a fixed pliers part (which might be designed as one piece or with a plurality of pieces) forms a fixed pliers jaw and a fixed hand lever. A movable pliers part (which might also be one single part or comprise a plurality of parts) then forms a movable pliers jaw. The movable pliers part is linked for being pivoted by a pivot joint to the fixed pliers part. Also a movable hand lever is linked for being pivoted by a pivot joint to the fixed pliers part. The movable hand lever is then connected by a driving connection (in particular a pressure lever or a toggle lever drive) to the movable pliers part.

For one proposal of the invention in this case the movable hand lever forms the counter latching element.

In this case, for one constructive design of the pressing pliers or crimping pliers the pivot joint by which the movable pliers part is linked for being pivoted to the fixed pliers part is arranged in the half of the longitudinal extension of the fixed pliers part on the side located remote from the pliers head (wherein in this case the pivot joint might e.g. be in a distance from the front end region of the pliers head which is more than 55%, more than 60%, more than 65%, more than 70% or even more than 75% of the longitudinal extension of the fixed pliers part). By the dislocation of the pivot joint away from the pliers head it is also possible to increase the pivot radius of the dies. For a given stroke of the dies in this way it is possible to reduce the pivoting angle of the dies over the working stroke. An excess pivoting of the dies relative to each other has shown to be negative for the pressing or crimping result.

Advantageous developments of the invention result from the claims, the description and the drawings. The advantages of features and of combinations of a plurality of features mentioned at the beginning of the description only serve as examples and may be used alternatively or cumulatively without the necessity of embodiments according to the invention having to obtain these advantages. Without changing the scope of protection as defined by the enclosed claims, the following applies with respect to the disclosure of the original application and the patent: further features may be taken from the drawings, in particular from the illustrated designs and the dimensions of a plurality of components with respect to one another as well as from their relative arrangement and their operative connection. The combination of features of different embodiments of the invention or of features of different claims independent of the chosen references of the claims is also possible, and it is motivated herewith. This also relates to features which are illustrated in separate drawings, or which are mentioned when describing them. These features may also be combined with features of different claims. Furthermore, it is possible that further embodiments of the invention do not have the features mentioned in the claims.

The number of the features mentioned in the claims and in the description is to be understood to cover this exact number and a greater number than the mentioned number without having to explicitly use the adverb "at least". For example, if a spring is mentioned, this is to be understood such that there is exactly one spring or there are two springs or more springs. Additional features may be added to these features, or these features may be the only features of the respective product.

The reference signs contained in the claims are not limiting the extent of the matter protected by the claims. Their sole function is to make the claims easier to understand.

BRIEF DESCRIPTION OF THE DRAWINGS

In the following, the invention is further explained and described with respect to preferred exemplary embodiments illustrated in the drawings.

DETAILED DESCRIPTION

Figure 1:
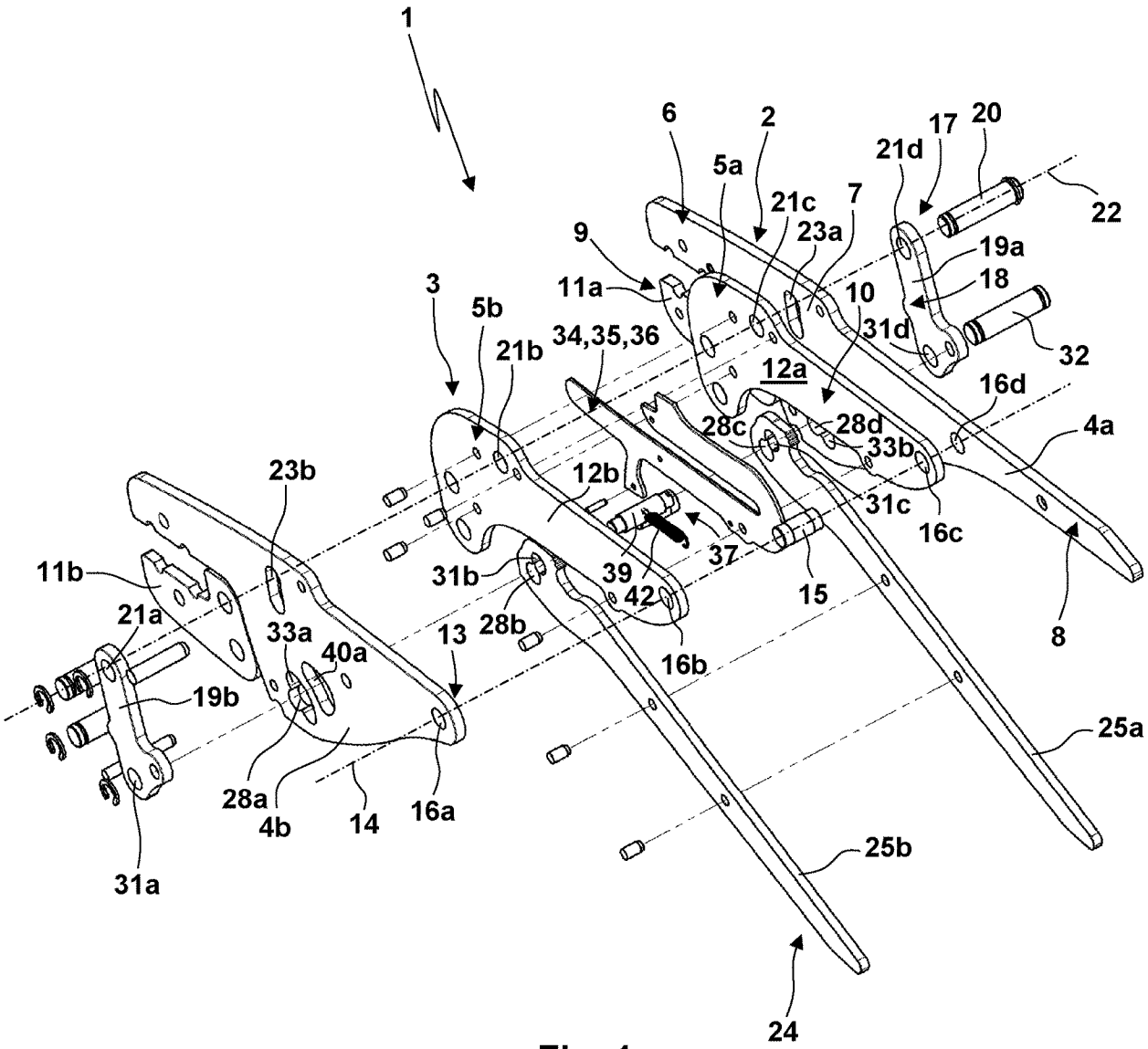
FIG. 1 shows crimping pliers in a three-dimensional exploded view.

FIGS. 1 to 11 show crimping pliers 1 in a plate-design. The crimping pliers 1 comprise a fixed pliers part 2 and a movable pliers part 3. The fixed pliers part 2 comprises two fixed pliers part plates 4*a*, 4*b*. The movable pliers part 3 comprises two movable pliers part plates 5*a*, 5*b*. The fixed pliers part 2 comprises a fixed pliers jaw 6, a connecting portion 7 and a fixed hand lever 8. For the shown embodiment the fixed pliers part plate 4*a* forms the fixed pliers jaw 6, the connecting portion 7 and the fixed hand lever 8. Instead, the fixed pliers part plate 4*b* only forms the fixed pliers jaw 6 and the connecting portion 7. The movable pliers part 3 comprises a movable pliers jaw 9. The movable pliers jaw 9 is held by a pivoting support 10. Here, the movable pliers part plates 5*a*, 5*b* comprise two parts, namely the pliers jaw plates 11*a*, 11*b* and the pivoting support plates 12*a*, 12*b*.

The movable pliers part 3 is supported at the fixed pliers part 2 for being pivoted about a pivot axis 14 by a pivot joint 13. For the shown embodiment this is provided by a pivot bolt 15. The pivot bolt 15 extends through through bores 16*a*, 16*b*, 16*c*, 16*d* of the movable pliers part plates 5*a*, 5*b* and the fixed pliers part plates 4*a*, 4*b* for allowing a pivoting movement. Here, the two movable pliers part plates 5*a*, 5*b* are accommodated between the fixed pliers part plates 4*a*, 4*b*. The pliers jaw plates 11*a*, 11*b* are attached to the pivoting support plates 12*a*, 12*b* and supported by the pivoting support plates 12*a*, 12*b* in a way such that the pliers jaw plates 11*a*, 11 b extend in parallel planes defined by the fixed pliers part plates 4*a*, 4*b* and such that these move in the aforementioned planes during the pivoting movement.

Approximately in the middle of the pivoting support plate 12 an end region of a pressure lever 18 (which is here formed by two pressure lever plates 19*a*, 19*b*) is linked by a pivot joint 17 to the movable pliers part 3. For the shown embodiment the pivot joint 17 is formed by a pivot bolt 20. The pivot bolt 20 is accommodated in through bores 21*a*, 21*b*, 21*c*, 21*d* of the pressure lever plate 19*b*, the pivoting support plate 12*b*, the pivoting support plate 12*a* and the pressure lever plate 19*a*. In this way a pivot axis 22 of the pivot joint 17 is defined. For the shown embodiment the two pressure lever plates 19 are not arranged within the fixed pliers part plates 4*a*, 4*b* but outside from the same. For this reason the pivot bolt 20 extends through elongated holes 23*a*, 23*b* of the fixed pliers part plates 4*a*, 4*b*. The elongated holes 23*a*, 23*b* are formed and arranged in a way such that the fixed pliers part plates 4*a*, 4*b* do not impede the movement of the pivot bolt 20 with the pivoting movement of the movable pliers part 3.

A movable hand lever 24 (which here comprises two movable hand lever plates 25*a*, 25*b*) is supported at the fixed pliers part 2 for being pivoted by a pivot joint 26 having a pivot axis 27. For this purpose the fixed pliers part plate 4*b*, the hand lever plate 25*b*, the hand lever plate 25*a* and the fixed pliers part plate 4*a* comprise through bores 28*a*, 28*b*, 28*c*, 28*d*. A pivot bolt 29 extends through the through bores 28*a*, 28*b*, 28*c*, 28*d*. The pivot bolt allows a relative pivoting movement of the movable hand lever 24 relative to the fixed pliers part 2.

The pressure lever 18 is connected by a pivot joint 30 to the hand lever 24 for being pivoted. For this purpose the pressure lever plates 19*a*, 19*b* comprise through bores 31*a*, 31*d*. At a position adjacent to the through bores 28*b*, 28*c* the hand lever plates 25*a*, 25*b* comprise through bores 31*b*, 31*c*. A pivot bolt 32 extends through the through bores 31*b*, 31*c*, allowing a pivoting movement. Due to the fact that for this purpose the pivot bolt 32 has to pass through the fixed pliers part plates 40*a*, 40*b*, the fixed pliers part plates 4*a*, 4*b* comprise elongated holes 33*a*, 33*b*. The elongated holes 33*a*, 33*b* provide that the motional degree of freedom of the pivot bolt 32 is not impeded.

The aforementioned couples of the components or plates extend symmetrically on both sides of a centered pliers plate plane. In the centered pliers plate plane a spring 34 is arranged which forms a part of a spring device 35. For the shown embodiment the spring 34 is embodied as U-shaped leaf spring or bending spring 36.

A forced locking unit 37 is used in the crimping pliers 1. The forced locking unit 37 comprises a locking pawl 38. The locking pawl is here supported by a locking pawl shaft 39. The locking pawl shaft 39 is supported for being rotated by the pressure lever plates 19*a*, 19*b*. The locking pawl shaft 39 extends (without limiting the motional degree of freedom) through through recesses 40*a*, 40*b* of the fixed pliers part plates 4*a*, 4*b*. In the region of the interaction with the locking pawl 38 and at its outer circumference the hand lever 24 forms a locking toothing. During the closing movement of the hand lever 24, due to the bias by a spring 42 the locking pawl 38 ratchet-like slides along the locking toothing 41. The geometry of the locking pawl 28 and the locking toothing 41 are here chosen such that by an engagement of the locking pawl 38 with the locking toothing 41 a movement in reversed direction is impossible. If instead the closed position of the crimping pliers 1 is reached, the locking pawl 38 has passed the locking toothing 41. Accordingly, the locking pawl 38 is able to turn due to the pulling force generated by the spring 42. After the turn the locking pawl 38 is enabled to slide along the locking toothing 41 during an opening movement.

Figure 2:
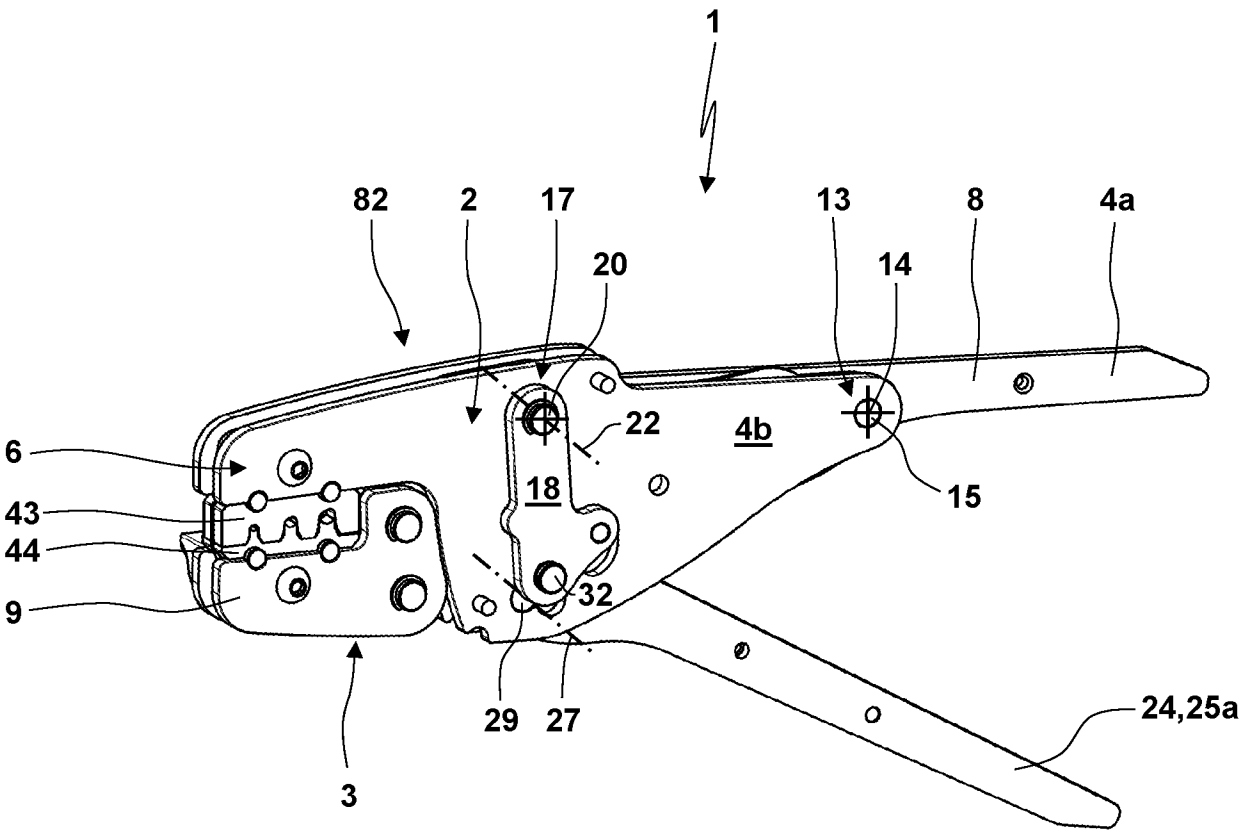
FIG. 2 shows the crimping pliers of FIG. 1 in a three-dimensional view.

In FIG. 2 it can be seen that the pliers jaws 6, 9 exchangeably support a die 43, 44. Preferably, here a connection of the pliers jaws 6, 9 to the dies 43, 44 is used as described in the patent publication DE 19 802 287 C1 corresponding to U.S. Pat. No. 6,053,025 A.

Figure 3:
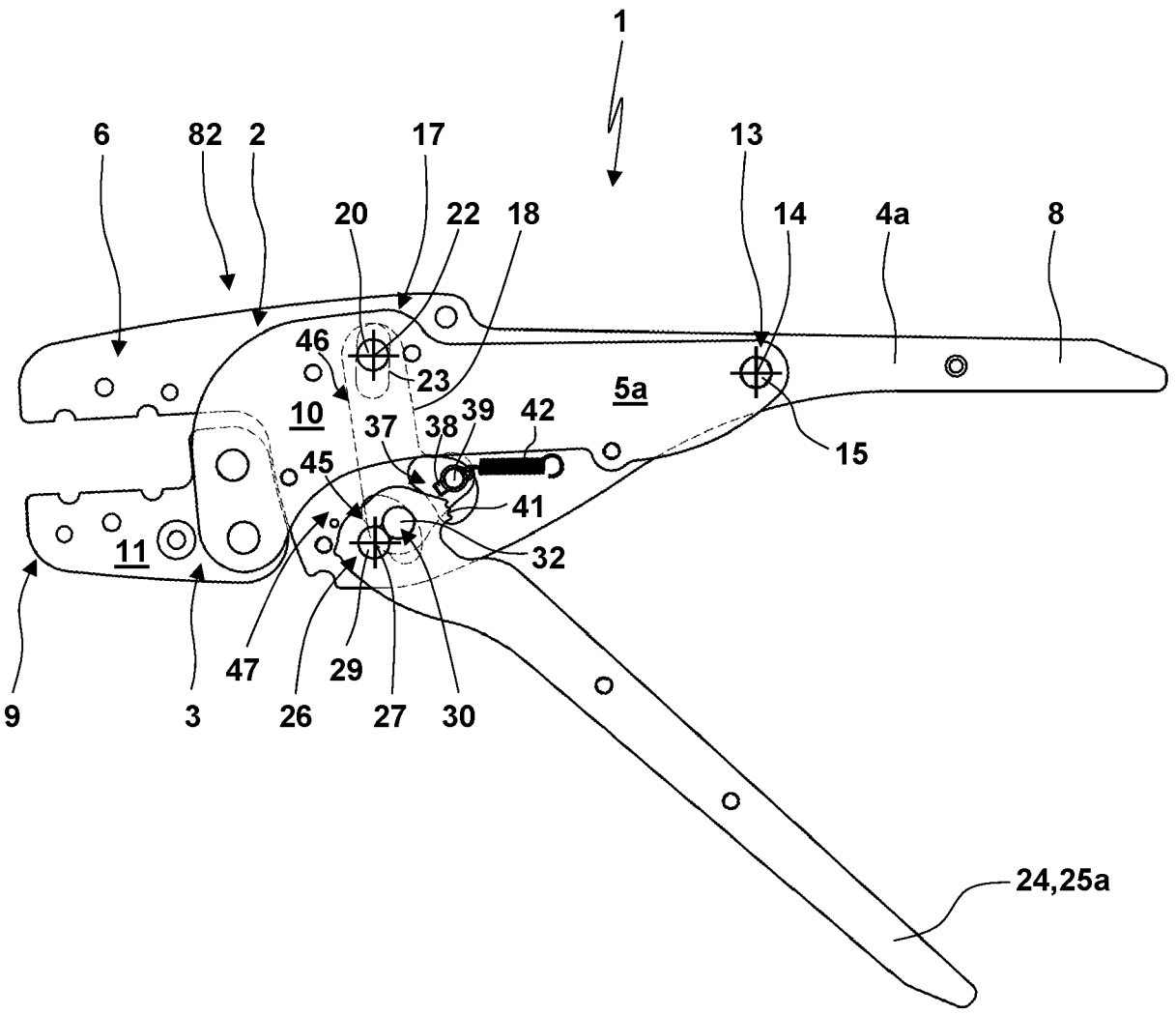
FIG. 3 shows components of the crimping pliers of FIGS. 1 and 2 for illustrating the driving kinetic in a side view.

The driving kinetic can be explained on the basis of the representation according to FIG. 3: due to the support of the movable pliers part 3 with the pivoting support 10 and the pliers jaw plate 11 by the pivot joint 13 at the fixed pliers part 2 a relative movement of the pliers jaws 6, 9 is possible. This relative movement of the pliers jaws 6, 9 is induced by a pivoting movement of the hand lever 24 relative to the fixed pliers part 2 about the pivot joint 26. Between the pivot joints 26, 30 the hand lever 24 forms a first toggle lever 45. Between the pivot joints 17, 30 the pressure lever 18A forms a second toggle lever 46. Here, the pivot joint 30 forms the toggle joint of a toggle lever drive 47 comprising the toggle levers 45, 46. The toggle lever drive 47 transforms the pivoting movement of the hand lever 24 to a pivoting movement of the movable pliers part 3 relative to the fixed pliers part 2.

Figure 4:
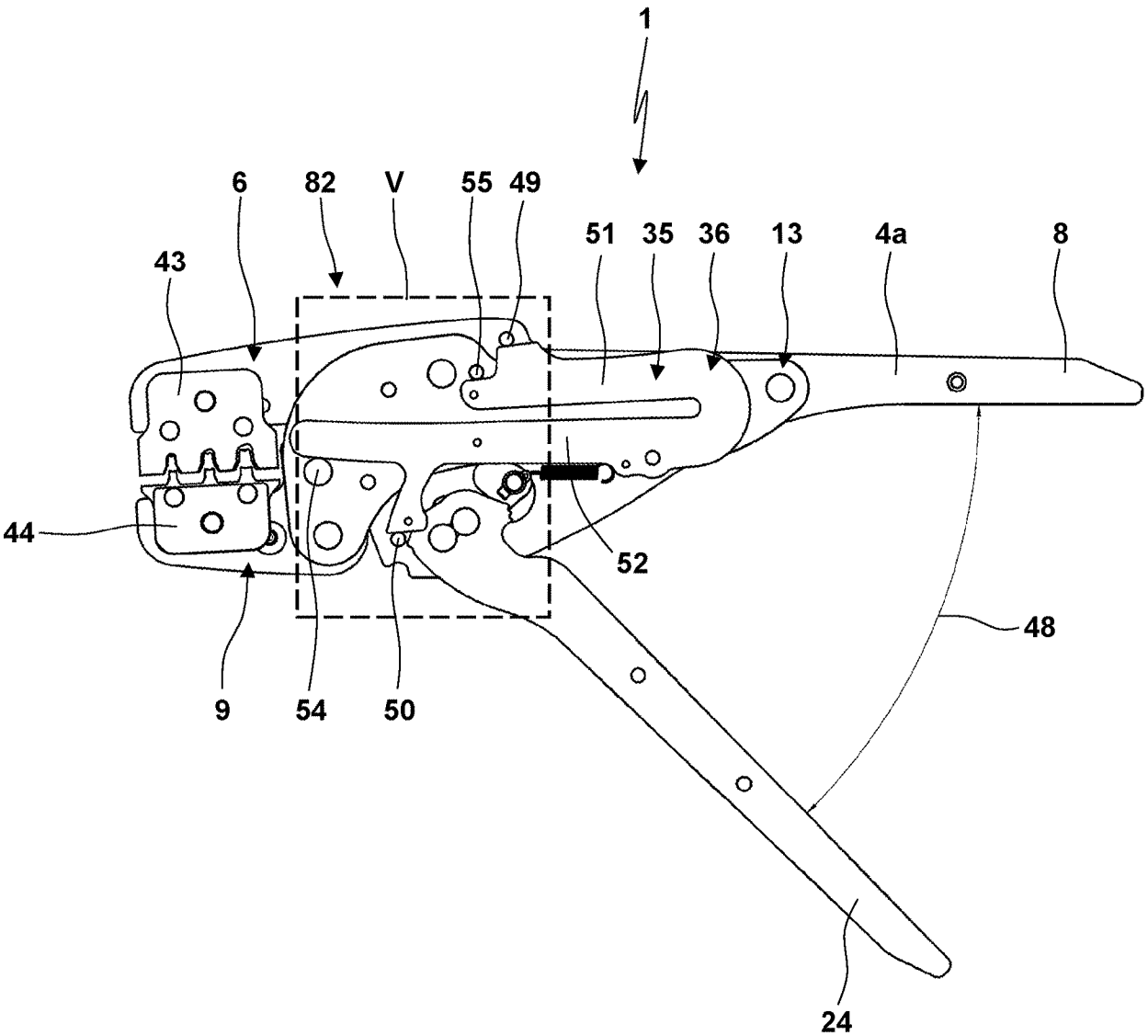
FIGS. 4, 6, 8, 10 show the crimping pliers of FIGS. 1 to 3 in different operational positions in side views.

In the following the spring device 45 is explained more in detail:

According to FIG. 4 the crimping pliers 1 are in an equilibrium position 48. In the equilibrium position 48 the opening angle of the hand levers is e.g. in the region of 40° to 50°, in particular 45° to 48°. The fixed pliers part 2 supports two stops 49, 50. Here, the stops 49, 50 are embodied as bolts carried in through bores of the fixed pliers part plates 4*a*, 4*b*. In the equilibrium position 48 spring arms 51, 52 (formed by the approximately parallel side legs of the U) of the U-shaped leaf spring or bending spring 36 contact associated stops 49, 50 at the outside. Here, it is possible that in the equilibrium position 48 the leaf spring or bending spring 36 and the spring arms 51, 52 are not pre-tensioned. However, it is also possible that the leaf spring or bending spring 46 is tensioned so that the leaf spring or bending spring 46 is pre-tensioned between the stops 49, 50.

On the sides of the leaf spring or bending spring 36 facing away from each other (and preferably in the free end regions of the spring arms 51, 52) the movable pliers part 3 supports or carries followers 54, 55. For the shown embodiment the followers 54, 55 are formed by follower bolts which are held in bores of the movable pliers part plates 5*a*, 5*b*. Here, the follower bolt forming the follower 54 is multifunctional because the follower bolt forming the follower 54 also serves for mounting the pliers jaw plate 11 to the pivoting support 10. In the equilibrium position 48 shown in FIGS. 4 and 5 the followers 54, 55 initially contact the leaf spring on bending spring 36 without here a significant contact force being generated.

Figure 6:
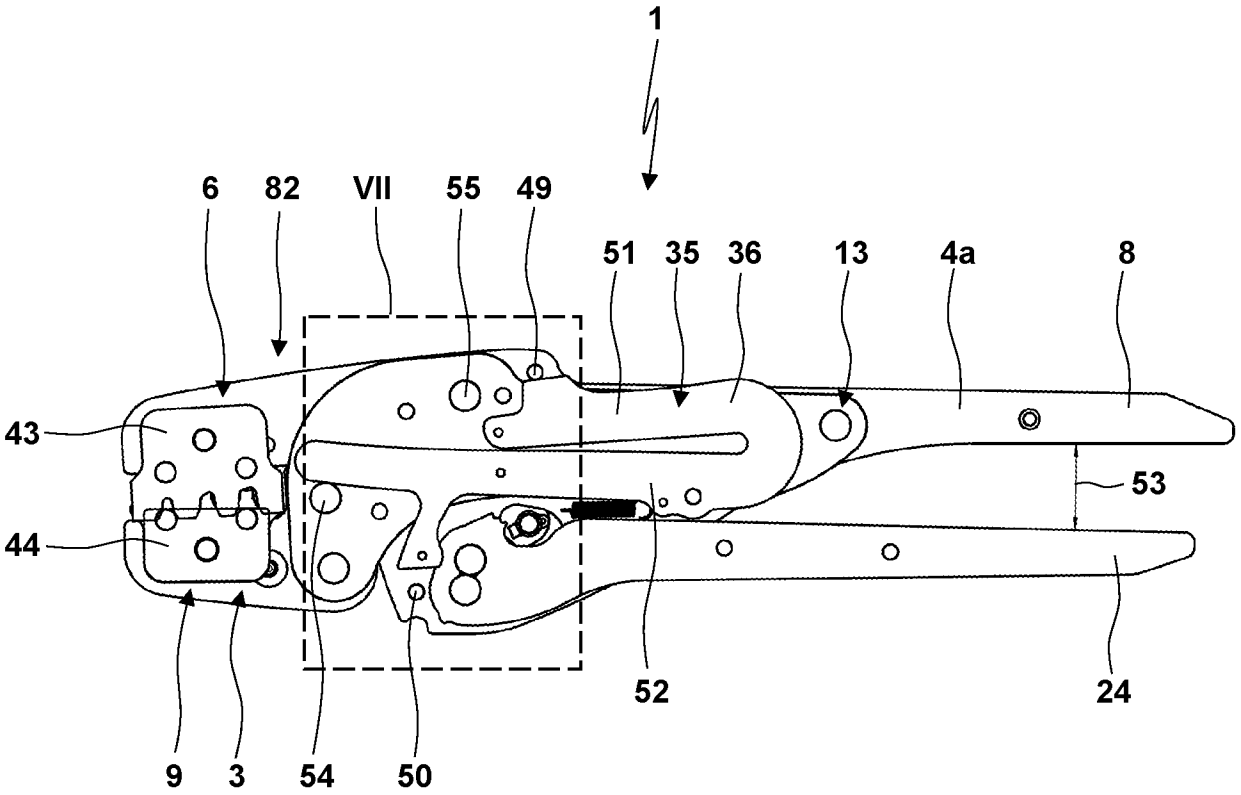
Figure 7:
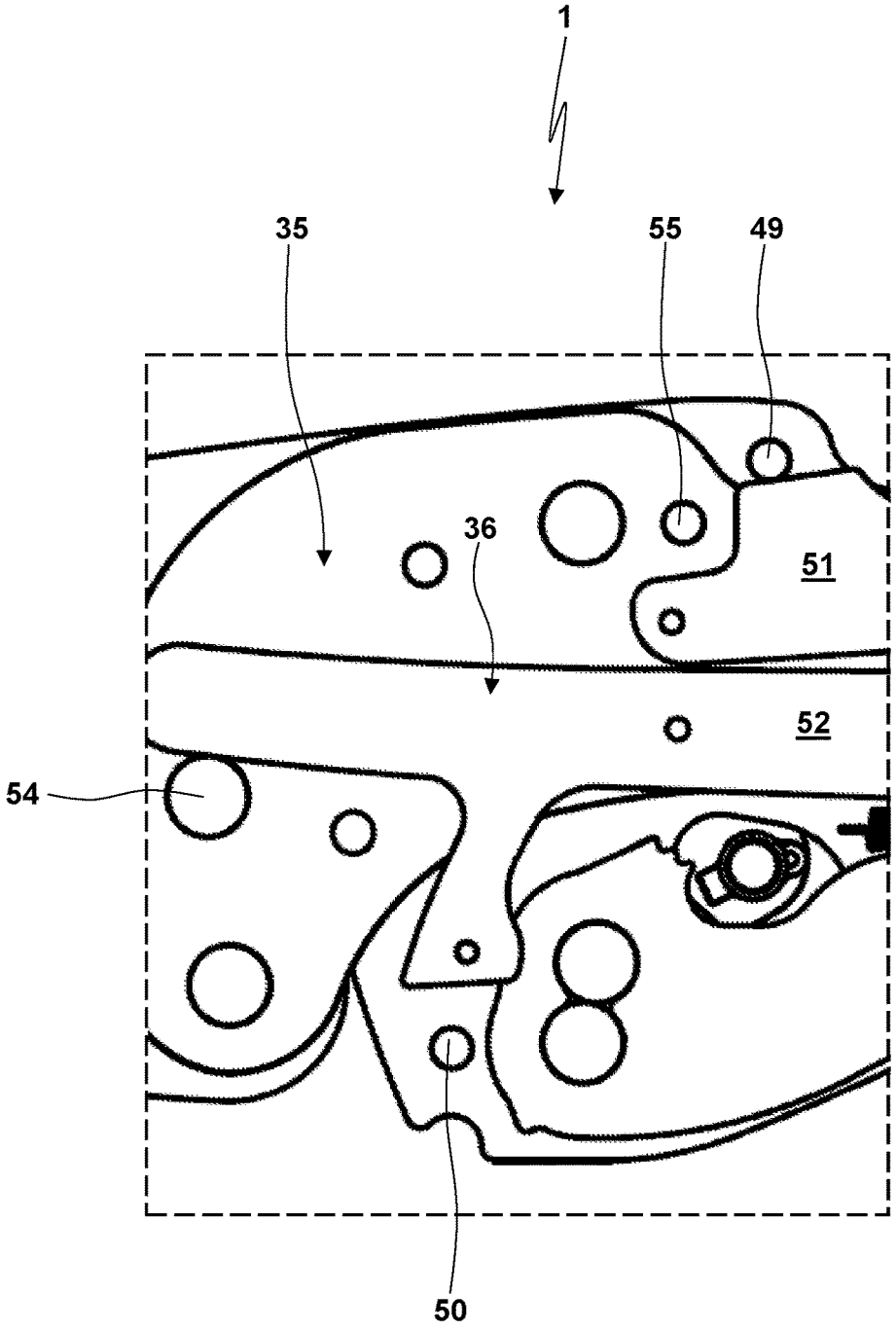

FIGS. 6 and 7 show the crimping pliers 1 in a closed position 53 wherein an angle of the hand levers 8, 24 is in the region of 0° to 10° (preferably in the region of 0° to 5°).

Figure 5:
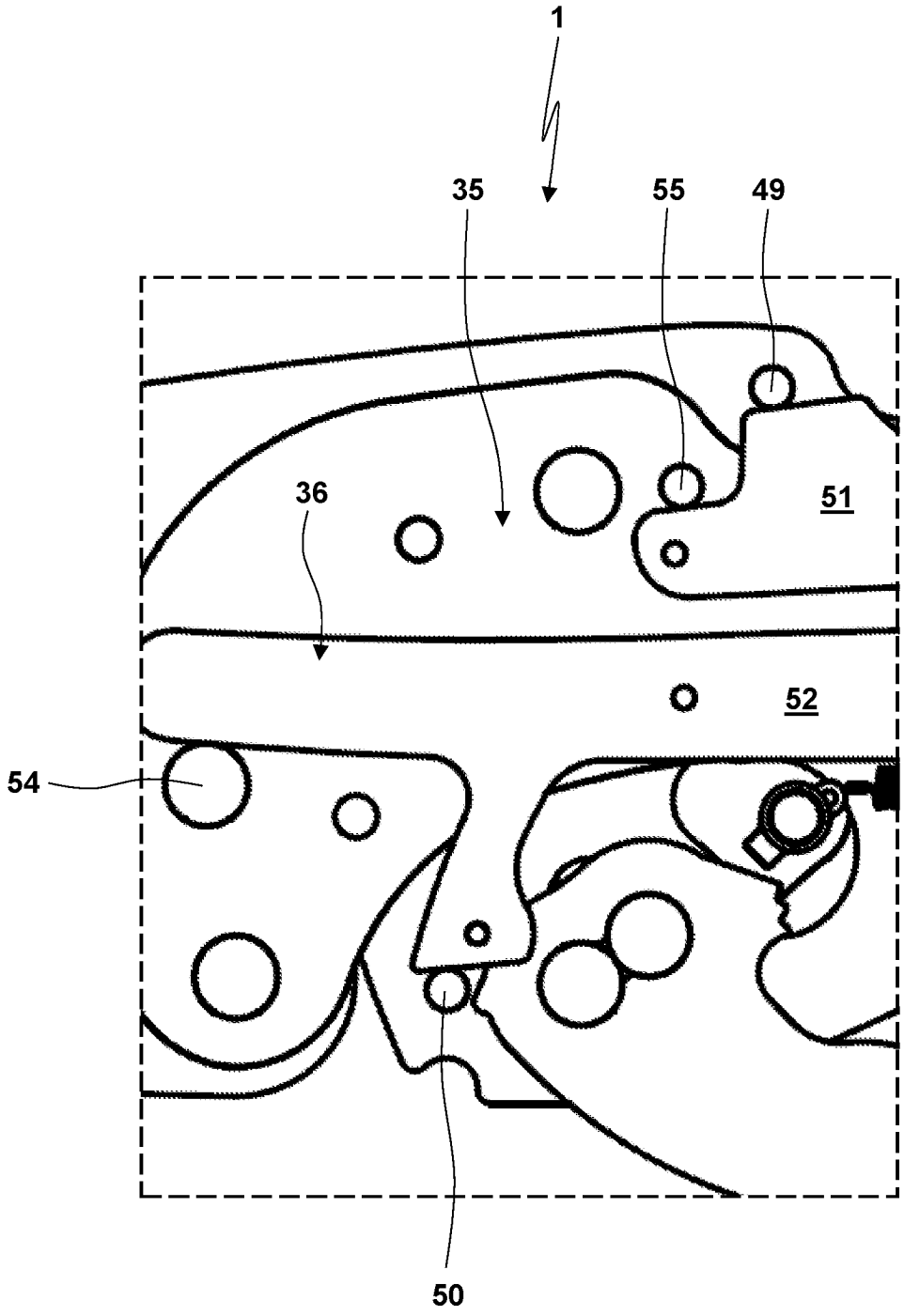
FIGS. 5, 7, 9, 11 show details V, VII, IX, XI of the crimping pliers of FIGS. 4, 6, 8, 10.

The pivoting movement of the movable pliers part 3 from the equilibrium position 48 according to FIGS. 4 and 5 into the closed position 53 according to FIGS. 6 and 7 (and the concurrent relative movement of the follower 54, 55 relative to the fixed pliers part 2) leads to the result that the follower 55 moves away from the spring arm 51. However, during this movement the follower 55 is pressed to an increasing extent against the spring arm 52. Accordingly, the leaf spring or bending spring 36 is additionally biased. The returning force of the leaf spring or bending spring 36 caused thereby results in an opening force being directed in opening direction. During the biasing of the leaf spring or bending spring 36 caused by the follower 54 the leaf spring or bending spring 36 separates from the stop 50. The leaf spring or bending spring 36 to an increasing extent moves away from the stop 50 up to the arrival in the closed position 53. When reaching the closed position according to FIGS. 6, 7 and when the forced locking unit 37 allows the opening movement of the hand levers 8, 24, for a removal of the hand forces the crimping pliers 1 elastically open in an automatic way. Due to the effect of the spring device 35 the crimping pliers 1 automatically return from the closed position 53 into the equilibrium position 48.

Figure 8:
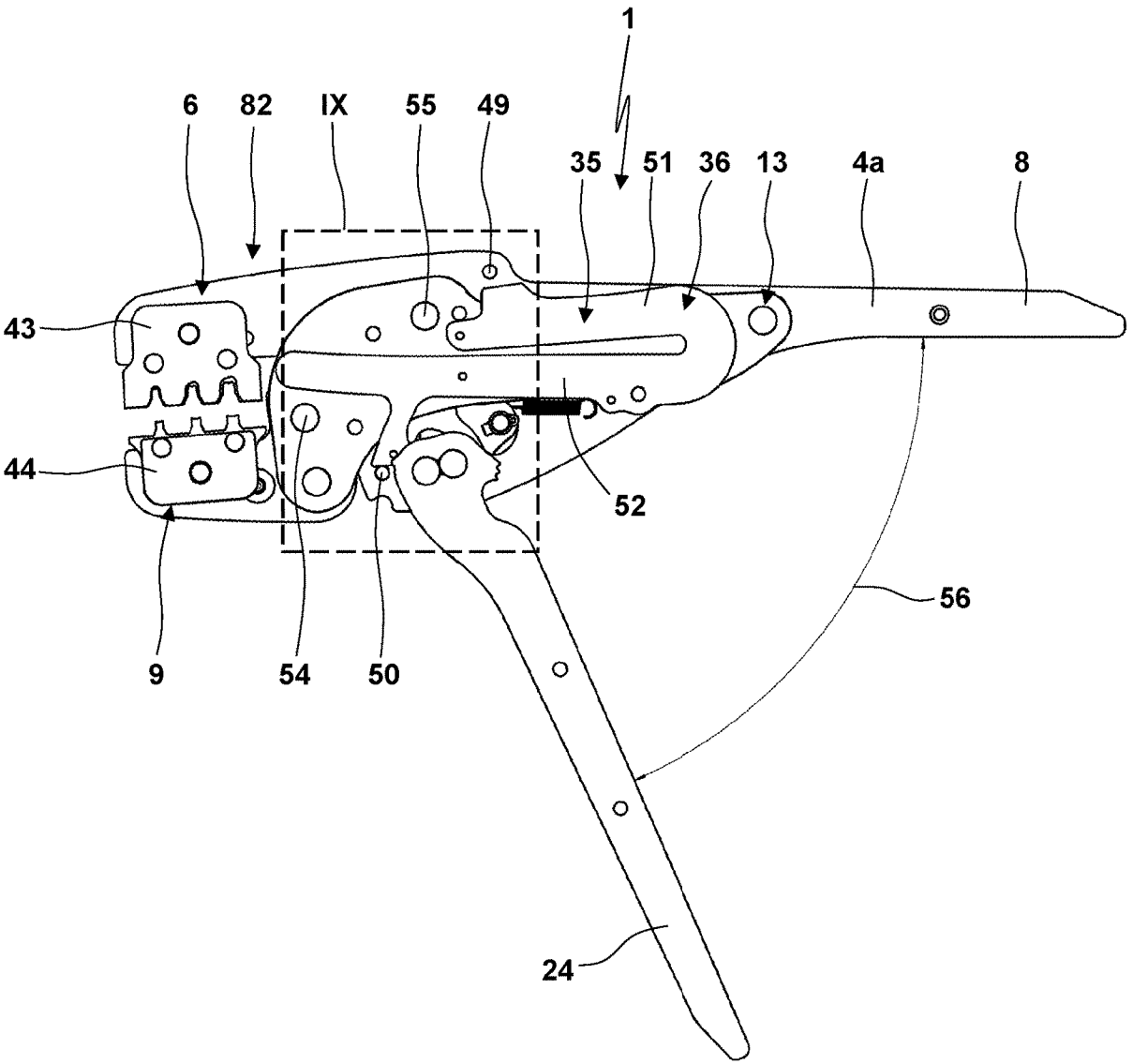
Figure 9:
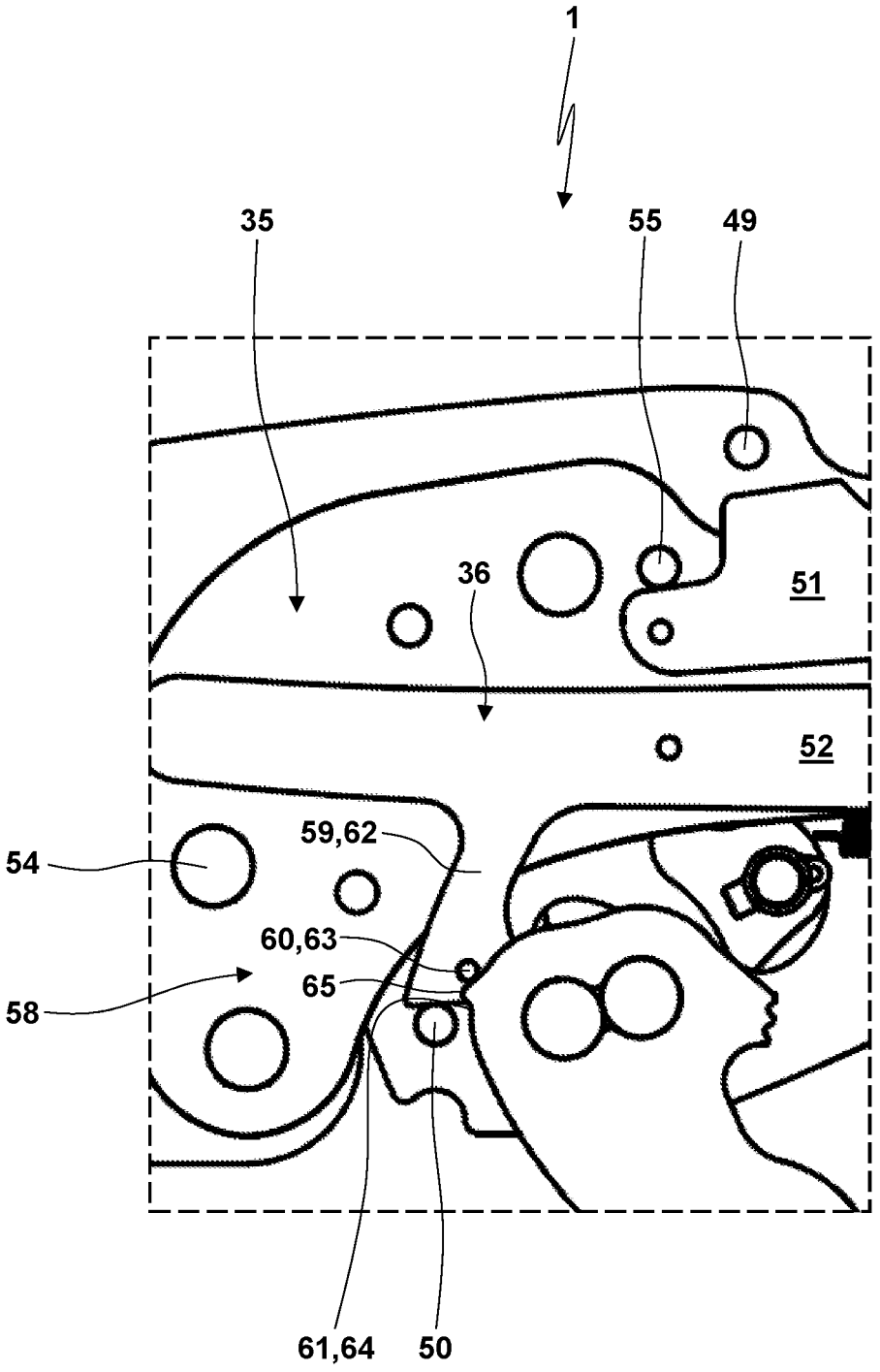
Figure 10:
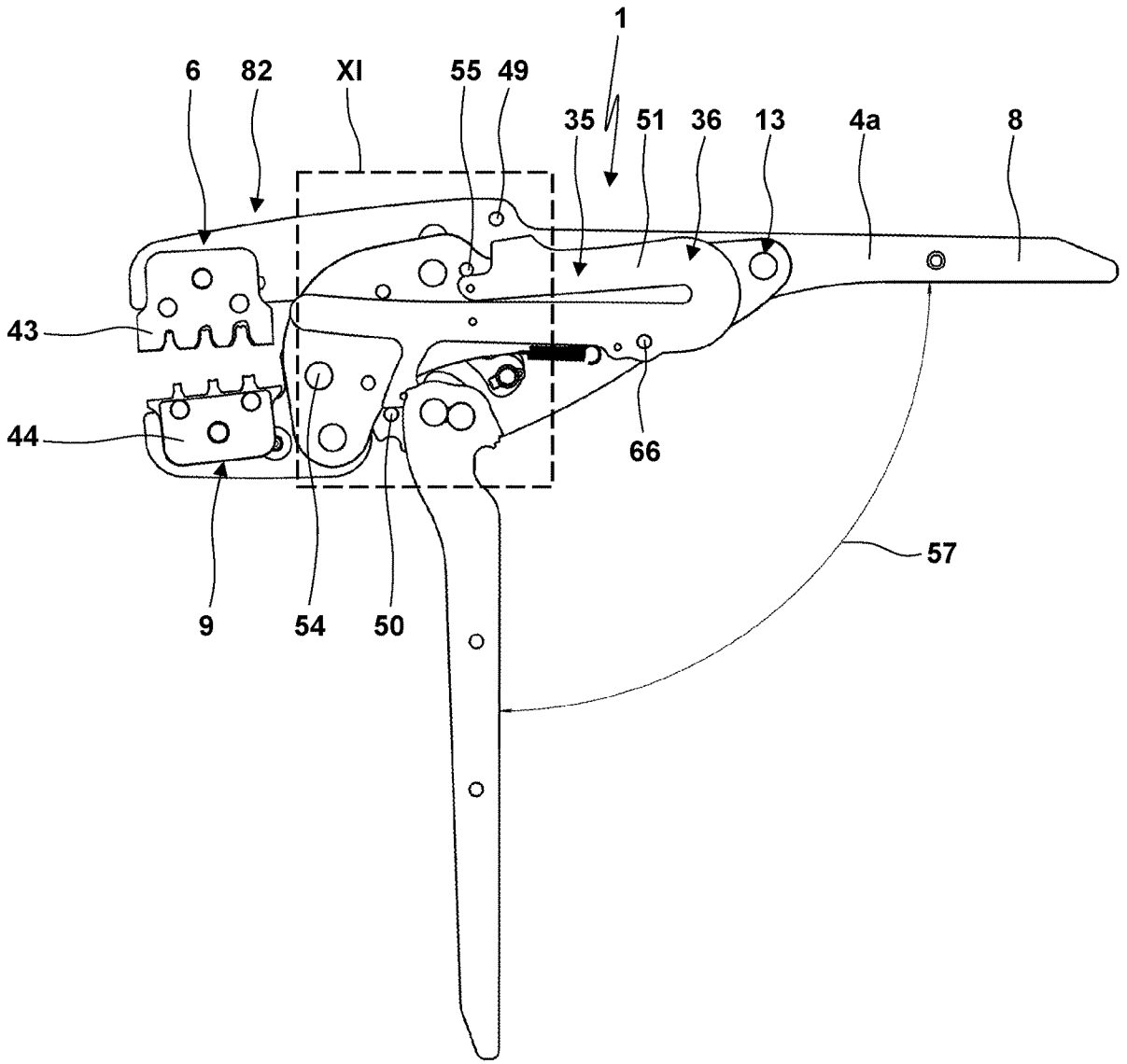
Figure 11:
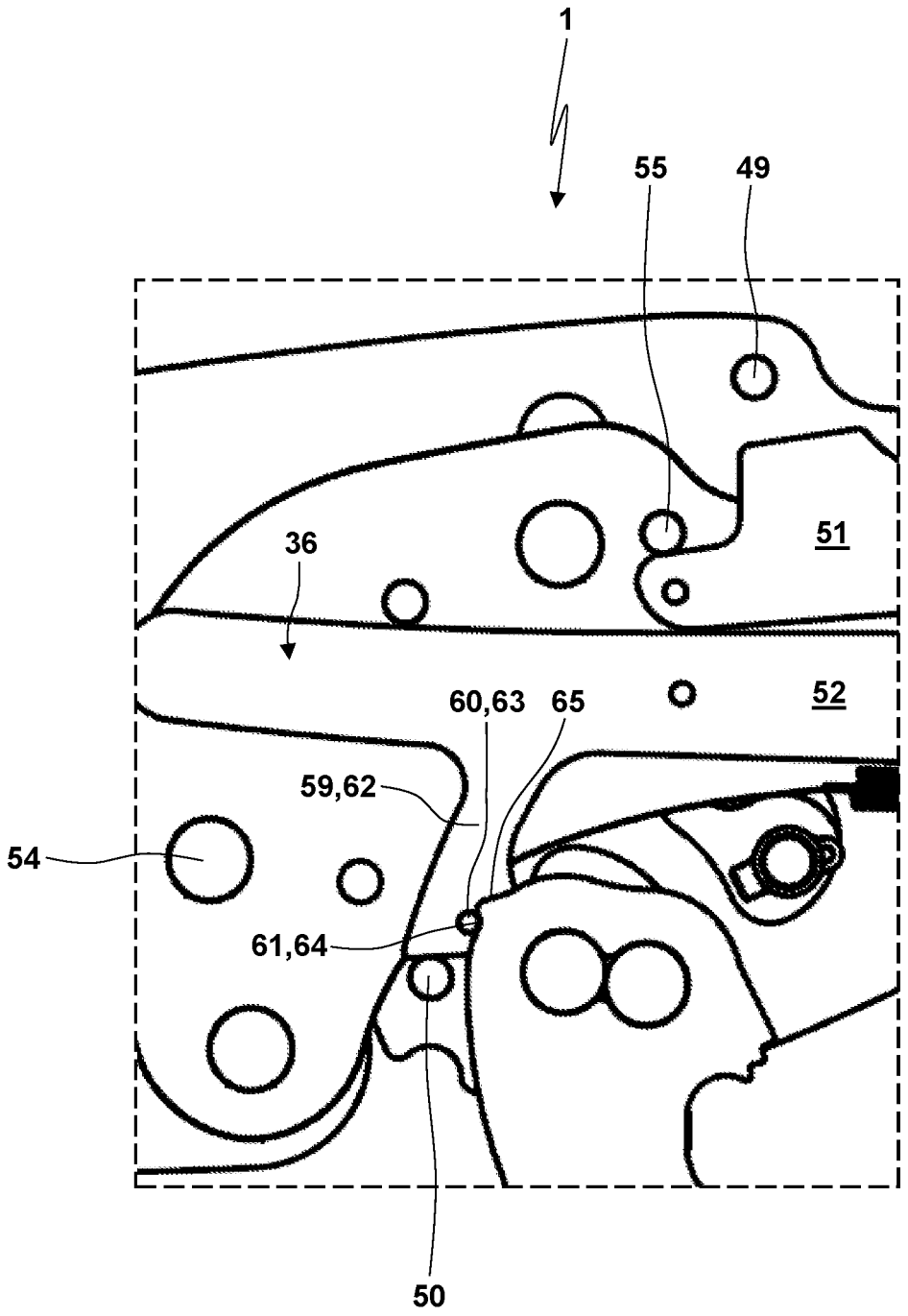

If instead the crimping pliers 1 are transferred from the equilibrium position 48 according to FIGS. 4 and 5 into a partially open position 56 according to FIGS. 8 and 9 or into a (maximally) open position 57 according to FIGS. 10 and 11 (where e.g. in the partially open position 56 the opening angle of the hand levers 8, 24 is in the region of 60° to 70°, preferably 65° to 68° and the opening angle of the hand levers 8, 24 in the open position 57 is in the range of 80° to 100° preferably 85° to 95°), the relative movement of the movable pliers part 3 relative to the fixed pliers part 2 leads to the result that the follower 54 separates from the spring arm 52 whereas the spring arm 52 is still supported at the stop 50. However, simultaneously a force is applied by the follower 55 to the spring arm 51 which increases with the opening movement. The increasing force leads to an increasing deformation of the leaf spring or bending spring 36 and to the movement of the spring arm 51 away from the stop 49. The increasing bias of the leaf spring or bending spring 36 leads to the consequence that the leaf spring or bending spring 36 applies a closing force upon the pliers part 2, 3 and so the pliers jaws 6, 9. The closing force has an orientation to restore the equilibrium position 48.

For the shown embodiment in an optional configuration the crimping pliers 1 comprise a latching device 58. By the latching device 58 it is possible to latch the open position in a way such that the open position 57 is maintained despite of the applied closing force of the spring device 35. Only when manually over-pressing the latched open position 57 (which leads to a reduction of the latching force or a complete removal of the latching force of the latching device 58) it is possible that by means of the closing force provided by the leaf spring or bending spring 36 the spring device 35 automatically restores the equilibrium position 48. In the latching device 58 a latching element 60 (which in particular forms a protrusion [or a recess]) is pressed by a latching spring 59 against a counter latching element 61 (which in particular forms a recess [or a protrusion]). Here, (at least in the neighborhood of the open position 57) a movement of the hand levers 8, 24 or the pliers jaws 6, 9 relative to each other leads to a relative movement of the latching element 60 and the counter latching element 61.

For the shown embodiment the latching spring 59 of the latching device 58 is formed by a latching spring arm 62 of the leaf spring or bending spring 36 (here in a longitudinal section which extends transverse to the spring arm 52 in the direction of the hand lever 24). In the free end region of the latching spring arm 62 cooperating with the hand lever 24 the latching spring arm 62 carries a pin 63 which forms the latching element 60.

The counter latching element 61 is in this case formed by a recess 64 of a latching contour 65 of the hand lever 24. When approaching the open position 57 the pin 63 slides along the latching contour 65 under an elastic bias by the latching spring arm 62. When reaching the open position 65, due to the elastic bias of the latching spring arm 62 the pin 63 is latched in the recess 64. Here, the contact force of the latching element 60 with the counter latching element 61 (so the pre-tension of the latching spring arm 62) and the geometry of the latching contour 65 (in particular the depths of the recess 64 and the inclination of the latching contour 65 in the region of the recess 64) are chosen such that the closing force of the spring device 35 is not able to overcome the latching effect of the latching device 58. Instead, for this purpose the user has to move the hand lever 24 in closing direction such that the latching element 60 can be released from the counter latching element 61 (so the pin 63 is able to exit from the recess 64)

It is possible that the leaf spring or bending spring 36 is supported for being pivoted by the movable pliers part 3.

Figure 12:
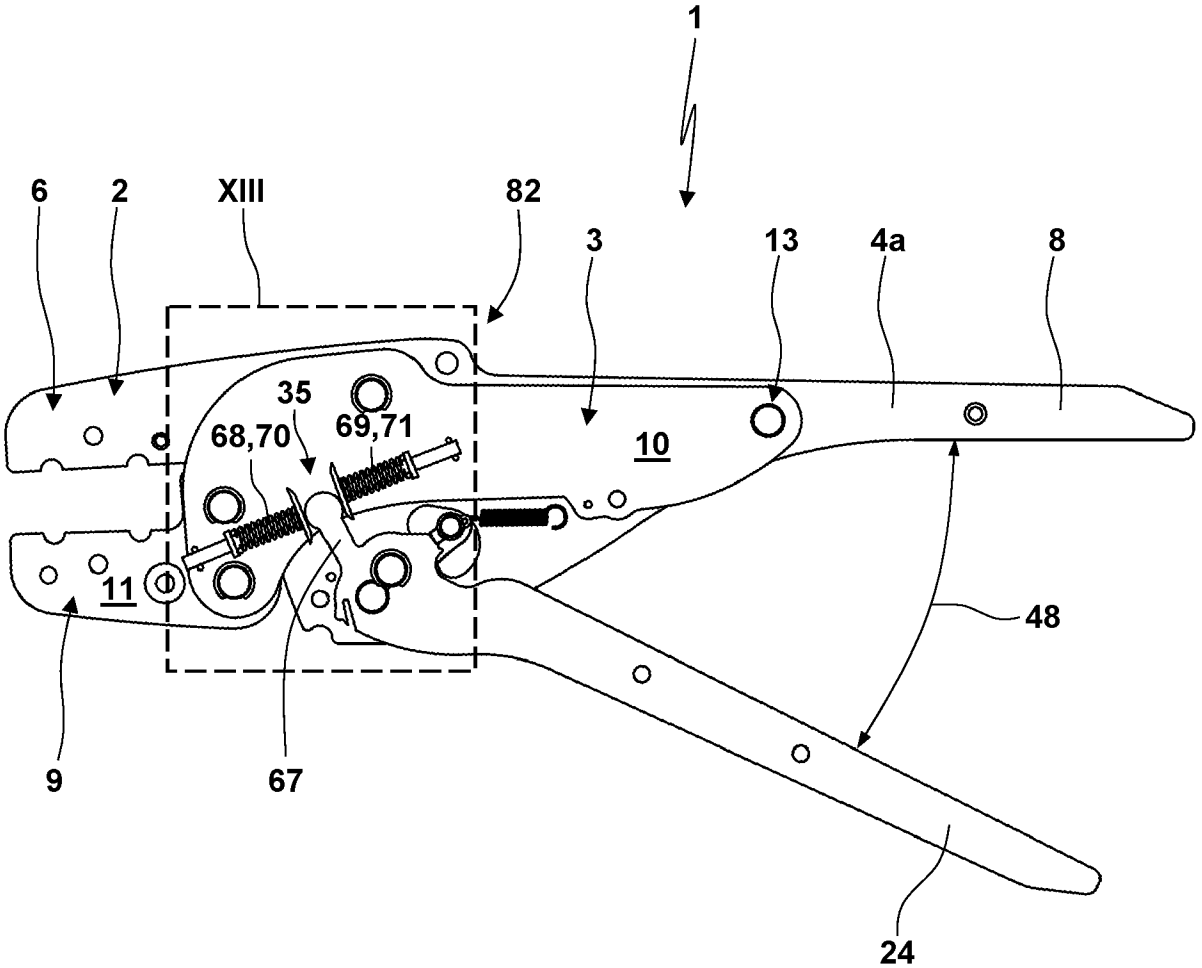
FIG. 12 shows an alternative embodiment of crimping pliers in a side view.
Figure 13:
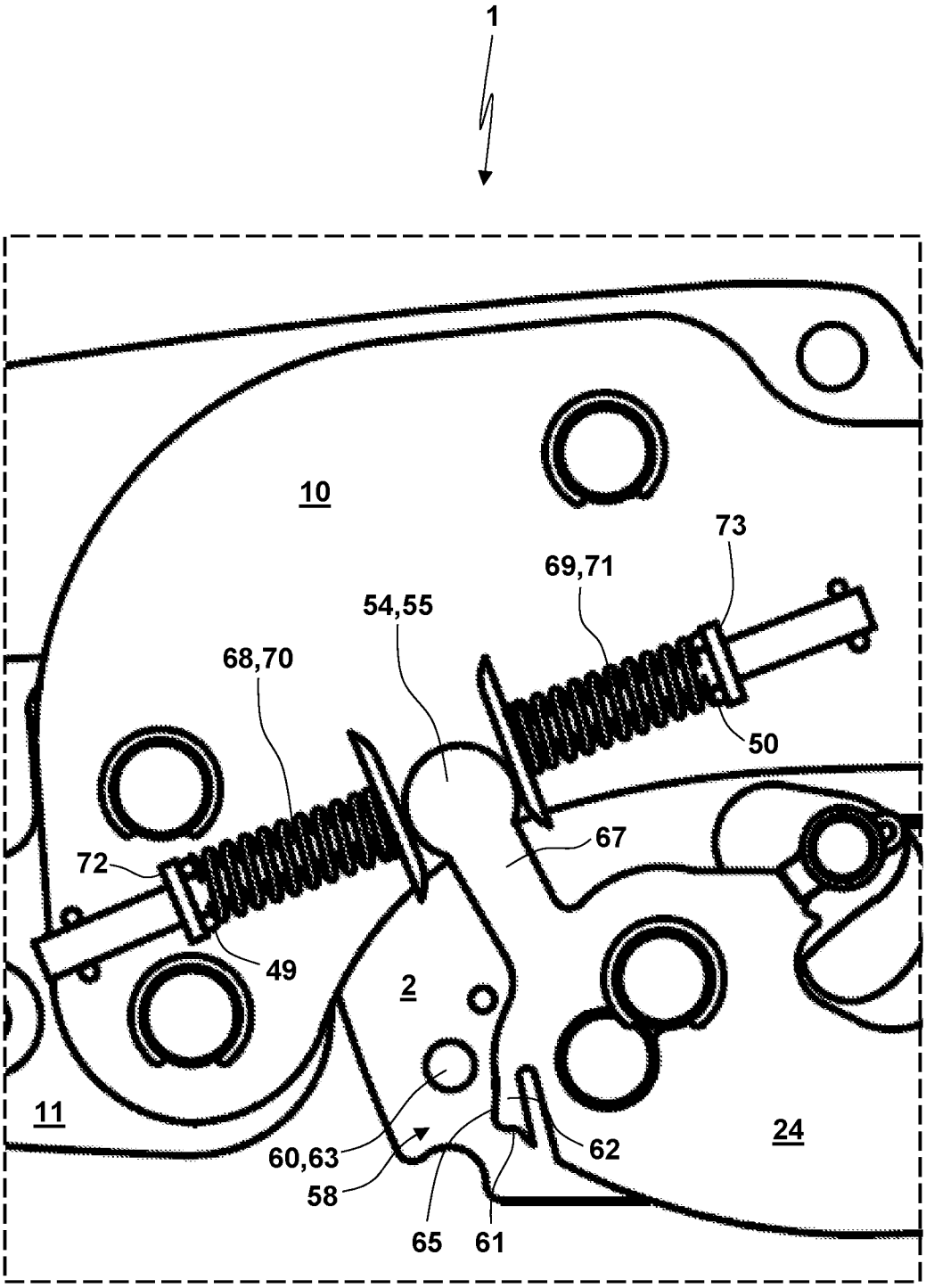
FIG. 13 shows a detail XIII of the crimping pliers of FIG. 12.

As an example FIGS. 12 and 13 show another embodiment of the spring device 35 which is also covered by the invention. In this case a coupling arm 67 of the hand lever 24 extends into the region of the movable pliers part 3. Here, in the equilibrium position 48 shown in FIGS. 12 and 13 the free end region of the coupling arm 67 is trapped between the two compression spring 68, 69. The compression spring 68 forms an opening spring 70 and the compression spring 69 forms a closing spring 71.

For the effect of the compression springs 68, 69 there are different options:

a) It is possible that the compression springs are not pre-tensioned in the equilibrium position 48 shown in FIGS. 12 and 13. In this case an opening of the hand levers 8, 24 leads to the result that the coupling arm 67 moves away from the opening spring 70. At the same time the closing spring 71 is compressed by the coupling arm 67 so that the closing spring 71 is able to generate the required closing force. In reverse direction a closing movement of the hand levers 8, 24 from the equilibrium position 48 leads to the result that the coupling arm 67 moves away from the closing spring 71. The opening spring 70 is biased to an increasing extent. In this way the required opening force can be generated.

b) It is also possible that in the equilibrium position 48 the compression springs 68, 69 do not apply any force upon the coupling arm 67. However, the compression springs 68, 69 are pre-tensioned (with the same pre-tensional forces or differing pre-tensional forces). An embodiment of this type is shown in FIGS. 12 and 13. In this case the expansion of the compression springs 68, 69 and the generation of a contact force of the same with the coupling arm 67 in the equilibrium position 48 is prevented because the movement of the compression spring 68, 69 coincides with the movement of a spring rod. The spring rod carries ring collars 72, 73. In the equilibrium position 48 the ring collars 72, 73 contact stops 49, 50 (which are here formed by the guidances of the compression springs 68, 69 or by the spring rods). A pivoting movement of the hand levers 8, 24 from the equilibrium position 48 requires to overcome the pre-tension of the respective compression spring 68, 69 arranged in moving direction. The compression spring 68, 69 not being arranged in movement direction is not able to follow the movement because this compression spring 68, 69 is hindered from a relaxation by the contact of the ring collar 72, 73 with the stop 49, 50. Accordingly, the stops 49, 50 define a maximum of the displacement of the compression springs 68, 69. For this embodiment the coupling arm 67 forms the followers 54, 55.

As an optional variant in the embodiment according to FIGS. 12 and 13 the latching device 58 comprises a latching element 60 (here a pin 63) carried by the fixed pliers part 2. The latching element 60 interacts with a latching contour 65 supported by an elastic latching spring arm 62 of the hand lever 24. The latching contour 65 forms the counter latching element 61, here a recess 64.

Figure 14:
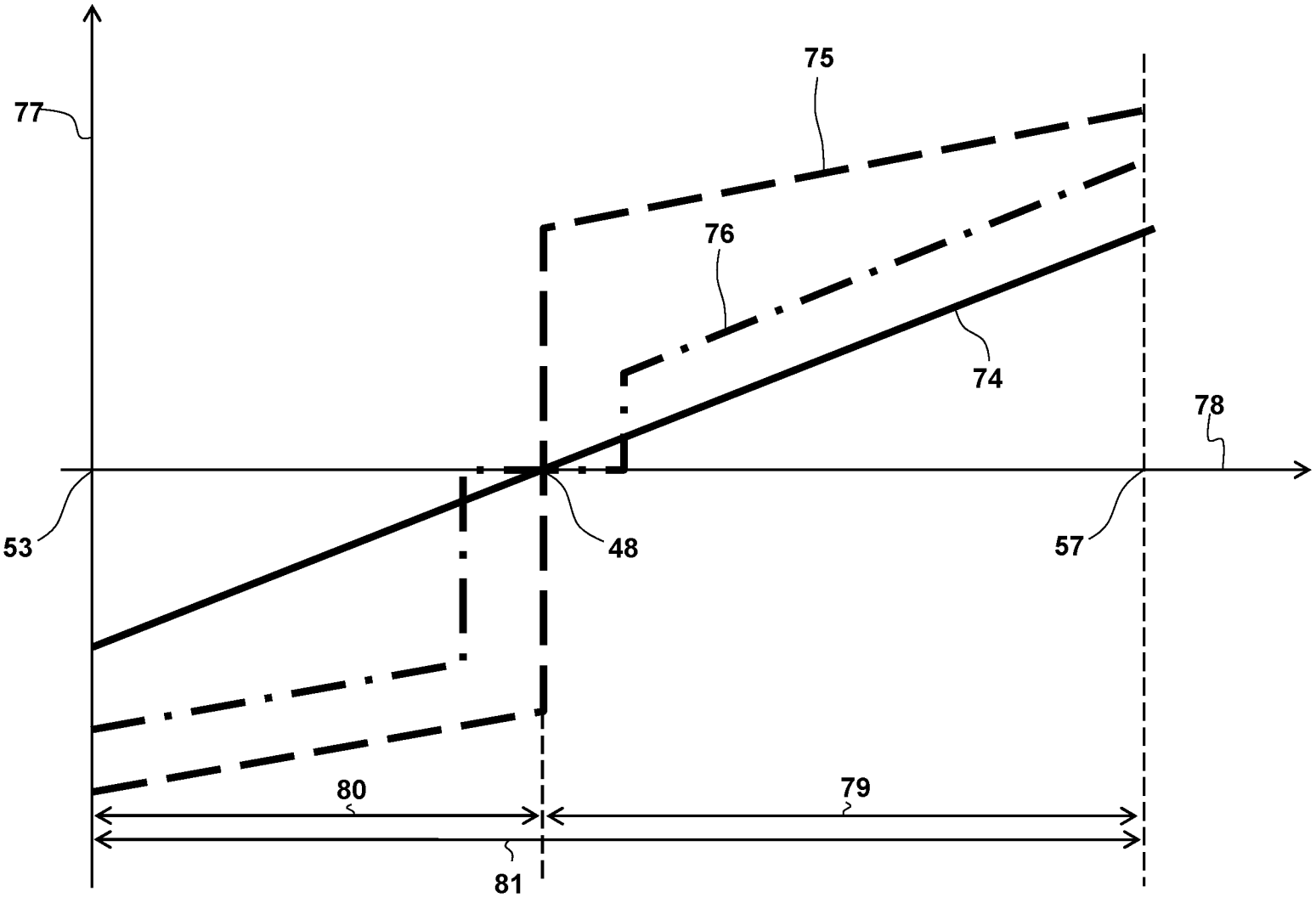
FIG. 14 shows different spring characteristics of a spring device of pressing pliers or crimping pliers.

FIG. 14 shows different characteristics 74, 75, 76 for the spring force 77 of the spring device 35 in dependence on the opening angle 78 of the hand levers 8, 24. These characteristics 74, 75, 76 represent general schematic spring force curves which can be achieved for any design of the spring device 35 and the pressing pliers or crimping pliers 1. In the characteristics 74, 75, 76 the origin of the abscissa corresponds to the closed position 53. Here, also the equilibrium position 48 is marked. The given maximum values of the characteristics 74, 75, 76 correlate to the open position 57. On the ordinate positive values represent an opening force. Negative values of the ordinate represent a closing force of the spring device 35.

For the characteristic 74 shown with solid line there is a smooth progress of the spring force of the spring device 35 without any jump. However, dependent on the spring characteristic of the used spring also a curved progress is possible. A characteristic 74 of this type can be provided already by one single spring, the not pre-tensioned equilibrium position of the spring corresponding to the equilibrium position 48. In this case, for a movement out of the equilibrium position 48 the single spring generates the opening force or the closing force dependent on the movement direction.

For the embodiment of FIGS. 1 to 11 generally a characteristic according to characteristic 74 can be achieved in the case that the leaf spring or bending spring 46 is not pre-tensioned in the equilibrium position 38. However, care has to be taken that in some cases due to differing leverages of the followers 54, 55 the characteristic 74 might have a kink in the region of the equilibrium position 48. This can purposefully be used in the constructive design if differing inclinations of the characteristic 74 in the working stroke parts are desired. For the embodiment shown in FIGS. 12 and 13 a characteristic 74 is used if in the equilibrium position 48 the opening spring 70 and the closing spring 71 are not pre-tensioned and the opening spring 70 and the closing spring 71 comprise one and the same spring stiffness.

The characteristic 75 shown in dashed line comprises a jump at the equilibrium position. This might be desirable if a notably stable equilibrium position 48 has to be provided with comparatively high returning forces into the same and/or if in the two working stroke parts the characteristic 75 should comprise a comparatively small inclination at a high force level. A characteristic 75 of this type can be achieved for the embodiment according to FIGS. 1 to 11 by pre-tensioning the leaf spring or bending spring 36 in the equilibrium position 48 between the stops 49, 50. The extent of the pre-tension defines the heights of the jump in the characteristic 75. Instead, the inclination of the characteristic 75 in the two working stroke parts is defined by the bending stiffness of the leaf spring or bending spring 46. For the embodiment of FIGS. 12 and 13 a characteristic 75 can be achieved by pre-tensioning the opening spring 70 and the closing spring 71 in the equilibrium position 48, where the opening spring 70 and the closing spring 71 (due to the interaction between the ring collars 72, 73 and the stops 49, 50) do not generate a force acting upon the followers 54, 55.

Finally, FIG. 14 with dotted line shows a characteristic 76 where it is not the exact equilibrium position 48 which is stable. Instead, the spring device in a neighboring region of the equilibrium position 48 does not generate a spring force so that this neighboring region is multi-stable. Only when leaving this neighboring region the shown characteristic 76 comprises a jump with a then increasing opening force respectively closing force. A characteristic 76 of this type can be achieved in the case that for the embodiment of FIGS. 1 to 11 in the equilibrium position the two followers 54, 55 do not already contact the leaf spring or bending spring as shown but these are arranged at a distance from the same. The distance of the followers 54, 55 from the leaf spring or bending spring 36 then defines the dimension of the neighboring region of the equilibrium position 48 for which no opening force and no closing force is generated. The characteristic resulting therefrom leads to jumps of the same heights when leaving the neighboring region (differing from the shown characteristic 76) with subsequent same inclinations of the characteristic in the working stroke parts 79, 80.

For the embodiment shown in FIGS. 12 and 13 a characteristic as the shown characteristic 76 can be achieved if also here in the equilibrium position 48 the followers 54, 55 are arranged with a distance from the compression springs 68, 69 contacting the stops 49, 50. By the choice of differing pre-tensions of the compression springs 68, 69 it is possible that (corresponding to the shown characteristic 76) the jumps when leaving the neighboring region of the equilibrium position 48 have differing heights. However, it is also possible that compression springs 68, 69 having differing stiffnesses are used so that in the two working stroke parts the characteristic 76 comprises different inclinations.

It is possible that any other springs as e.g. pulling springs are used between any components of the crimping pliers 1 moved relative to each other during the working stroke without leaving the frame of the invention. Outside from the equilibrium position 48 (or outside from the above explained neighboring region wherein the spring device 35 does not generate a force) a first working stroke part 79 denotes operating positions of the crimping pliers 1 between the open position 57 and the equilibrium position 48 whereas a second working stroke part 80 characterizes operating positions of the crimping pliers 1 between the equilibrium position 48 and the closed position 53. The whole stroke between the open position 57 and the closed position 53 is denoted as working stroke 81.

With respect to the functionally it is possible to distinguish on the one hand the axial section with the hand levers 8, 24 and on the other hand a pliers head 82 at the crimping pliers 1. In the region of the pliers head 82 the pliers jaws 6, 9 with the dies 43, 44, the driving connection or mechanism with the toggle lever drive 47, the spring device 35 and the forced locking unit 37 are arranged.

In the present specification the invention has primarily been explained in connection with crimping pliers 1. A corresponding design is also possible for pressing pliers. The inventive features and designs can e.g. be integrated in pressing pliers according to the prior art mentioned above.

Here, the design of crimping pliers 1 has been described for a plate-design where components are partially formed by a couple of parallel plates. In fact, the same base principle can be embodied in crimping pliers 1 if there are no couples of plates but there is only one single constructional element of this type.

Within the frame of the present description constructional elements corresponding to each other or being similar with respect to the function and/or the design are denoted with the same reference numerals but differing additional letters a, b, . . . . In some cases reference is made to these constructional elements without making use of the additional letter.

Many variations and modifications may be made to the preferred embodiments of the invention without departing substantially from the spirit and principles of the invention. All such modifications and variations are intended to be included herein within the scope of the present invention, as defined by the following claims.

We claim:

1. Pliers for pressing or crimping a workpiece, the pliers comprising:

a) two pliers jaws, b) two hand levers, c) a driving mechanism which drivingly couples the hand levers to the pliers jaws such that it is possible to induce a working stroke from an open position of the pliers jaws into a closed position of the pliers jaws by a manually induced relative movement of the hand levers, the working stroke comprising:

ca) an equilibrium position between the open position and the closed position of the pliers jaws, cb) a first working stroke part located between the open position and the equilibrium position of the pliers jaws configured to clamp the workpiece between the pliers jaws and cc) a second working stroke part located between the equilibrium position and the closed position of the pliers jaws configured to press or crimp the workpiece clamped between the pliers jaws, d) a spring device positioned on the driving mechanism which biases the pliers jaws toward and away from each other and which da) in the equilibrium position does not apply a net force to the pliers jaws, db) in the first working stroke part applies a closing force to the pliers jaws to bring the pliers jaws into the equilibrium position without manual application of force to the two hand levers and dc) in a second working stroke part applies an opening force to the pliers jaws such that when the second working stroke part is completed and the hand levers are released the pliers jaws return to the equilibrium position.

2. The pliers of claim 1 wherein the spring device comprises a) a closing spring which produces the closing force in the first working stroke part and b) an opening spring which produces the opening force in the second working stroke part.

3. The pliers of claim 1 wherein the spring device comprises a spring which produces both a) the closing force in the first working stroke part as well as b) the opening force in the second working stroke part.

4. The pliers of claim 3 wherein the spring is embodied as a U-shaped bending spring or leaf spring.

5. The pliers of claim 4 wherein spring arms of the U-shaped bending spring or leaf spring extend in a direction of a longitudinal axis of a pliers head or in the direction of the hand levers when closed relative to each other.

6. The pliers of claim 1 wherein a) at least one stop is provided which defines an external displacement of a spring base of the spring device, b) at least one follower is provided and c) in one of said first working stroke part and said second working stroke part, a follower moves the spring base of the spring device away from the stop.

7. The pliers of claim 6 wherein a) the stop is fixed at or assembled to a pliers head or supported by a pliers head and b) the follower is fixed at or assembled to the one of the pliers jaws which is moved relative to the pliers head over the working stroke or the follower is formed by the one of the pliers jaws which is moved relative to the pliers head over the working stroke.

8. The pliers of claim 1 wherein a) a forced locking unit is provided which secures the pliers jaws in a reached partially closed position against an opening movement and allows an opening movement of the pliers jaws only when the second working stroke part has been completed and b) the spring device moves the pliers jaws into the equilibrium position when the working stroke has been completed.

9. The pliers of claim 1 wherein the pliers comprise a latching device or a locking device which secures the open position of the pliers jaws.

10. The pliers of claim 9 wherein a spring of the spring device is multifunctional in that the spring a) produces the opening force or the closing force and b) produces a latching force of the latching device or a locking force of the locking device.

11. The pliers of claim 10 wherein a) the spring of the spring device is a U-shaped bending spring or leaf spring b) a spring arm of the U-shaped bending spring or leaf spring forms a latching spring arm of the latching device and c) the latching spring arm elastically supports a latching element which is latched with a counter latching element which is moved relative to the latching element over the working stroke.

12. The pliers of claim 11 wherein a) the pliers jaws are embodied as a fixed pliers jaw and a movable pliers jaw b) the hand levers are embodied as a fixed hand lever and a movable hand lever, c) a fixed pliers part forms the fixed pliers jaw and the fixed hand lever, d) a movable pliers part forms the movable pliers jaw and the movable pliers part is linked for being pivoted by a pivot joint to the fixed pliers part, e) the movable hand lever is linked for being pivoted by a pivot joint to the fixed pliers part and f) the movable hand lever is connected by the driving mechanism to the movable pliers part.

13. The pliers of claim 12 wherein the movable hand lever forms the counter latching element.

14. The pliers of claim 1 wherein a) the pliers jaws are embodied as a fixed pliers jaw and a movable pliers jaw, b) the hand levers are embodied as a fixed hand lever and a movable hand lever, c) a fixed pliers part forms the fixed pliers jaw and the fixed hand lever, d) a movable pliers part forms the movable pliers jaw and the movable pliers part is linked for being pivoted by a pivot joint to the fixed pliers part, e) the movable hand lever is linked for being pivoted by a pivot joint to the fixed pliers part and f) the movable hand lever is connected by the driving mechanism to the movable pliers part.

15. The pliers of claim 14 wherein the driving mechanism comprises a toggle lever drive.

16. The pliers of claim 14 wherein the pivot joint by which the movable pliers part is linked for being pivoted to the fixed pliers part is located in a half of the fixed pliers part on a side of the fixed pliers part remote from a pliers head.

17. The pliers of claim 1 wherein the driving mechanism comprises a toggle lever drive.

* * * * *